US005728265A

United States Patent [19]

Saint Victor et al.

[11] Patent Number: 5,728,265

[45] Date of Patent: Mar. 17, 1998

[54] PROCESS FOR ENHANCING WHITE LIQUOR PENETRATION INTO WOOD CHIPS BY CONTACTING THE CHIPS WITH A MIXTURE OF THE WHITE LIQUOR AND A POLYMETHYLALKYL SILOXANE

[75] Inventors: Marie-Esther Saint Victor, Blue Bell; David I. Devore, Langhorne, both of Pa.; Barbara Balos Bowker, Jacksonville, Fla.; John J. Palmer, Stanfield; Vincent T. Stine, Charlotte, both of N.C.

[73] Assignee: Henkel Corporation, Plymouth Meeting, Pa.

[21] Appl. No.: 632,191

[22] Filed: Apr. 15, 1996

Related U.S. Application Data

[63] Continuation-in-part of Ser. No. 574,053, Dec. 18, 1995, abandoned.

[51] Int. Cl.[6] ..... D21C 3/02; D21C 3/20

[52] U.S. Cl. ..... 162/72; 162/80; 162/82

[58] Field of Search ..... 162/82, 72, 17, 162/80, 19

[56] References Cited

U.S. PATENT DOCUMENTS

| | | | |
|---|---|---|---|
| 3,147,179 | 9/1964 | Simmons et al. | 162/76 |
| 3,883,391 | 5/1975 | Phillips | 162/70 |
| 3,941,649 | 3/1976 | Wallin | 162/19 |
| 4,155,806 | 5/1979 | Mannbro | 162/19 |
| 4,162,933 | 7/1979 | Sherman et al. | 162/17 |
| 4,172,006 | 10/1979 | San Clemente | 162/65 |
| 4,190,490 | 2/1980 | Tomlinson, II | 162/19 |
| 4,426,254 | 1/1984 | Wood et al. | 162/72 |
| 4,673,460 | 6/1987 | Raff | 162/75 |
| 4,952,277 | 8/1990 | Chen et al. | 162/72 |
| 4,978,425 | 12/1990 | Beller et al. | 162/49 |
| 5,032,976 | 7/1991 | Beller et al. | 364/151 |
| 5,060,132 | 10/1991 | Beller et al. | 364/158 |
| 5,066,362 | 11/1991 | Meredith | 162/17 |
| 5,183,535 | 2/1993 | Tikka | 162/19 |
| 5,250,152 | 10/1993 | Ling et al. | 162/72 |
| 5,266,690 | 11/1993 | McCurry, Jr. et al. | 536/18.6 |
| 5,282,931 | 2/1994 | LeClerc et al. | 162/49 |
| 5,474,709 | 12/1995 | Herzig et al. | 252/321 |

FOREIGN PATENT DOCUMENTS

| | | |
|---|---|---|
| 1079906 | 6/1980 | Canada . |
| 1087354 | 10/1980 | Canada . |
| 1147105 | 5/1983 | Canada . |
| 1154208 | 9/1983 | Canada . |
| 1157209 | 11/1983 | Canada . |
| 1277110 | 12/1990 | Canada . |
| 951325 | 3/1964 | United Kingdom . |
| 1526621 | 9/1978 | United Kingdom . |
| 2155966 | 10/1985 | United Kingdom . |
| 9205854 | 4/1992 | WIPO . |

OTHER PUBLICATIONS

*Pulp and Paper Manufacture*, Third Ed., vol. 5, 1989, p. 50.

*Primary Examiner*—Steven Alvo

*Attorney, Agent, or Firm*—Wayne C. Jaeschke; John E. Drach; Steven J. Trzaska

[57] ABSTRACT

The efficiency by which pulp cooking liquor components penetrate the wood and enable lignin and resins to be removed from the cellulosic materials is increased by contacting wood chips and the like with a liquid mixture comprised of white liquor containing at least one surfactant selected from the group consisting of a polymethylalkylsiloxane; a co- and terpolymer of silicone and a polyhydric alcohol; an alkoxylated aryl phosphate; an alkoxylated branched alkyl phosphate; an alkoxylated branched alcohol; an alkyl polyglycoside, an alkoxylated alkyl polyglycoside; a mixture of alkali metal salts of alkyl aromatic sulfate, a sulfosuccinate and a silicone; and combinations thereof; for a residence time effective to extract resinous components without substantial degradation of cellulose and thereafter heating at least a portion of the resulting mixture and wood chips.

15 Claims, No Drawings

PROCESS FOR ENHANCING WHITE LIQUOR PENETRATION INTO WOOD CHIPS BY CONTACTING THE CHIPS WITH A MIXTURE OF THE WHITE LIQUOR AND A POLYMETHYLALKYL SILOXANE

CROSS-REFERENCE TO RELATED APPLICATIONS

This application is a continuation-in-part of application Ser. No. 08/574,053, filed on Dec. 18, 1995, and now abandoned, the entire contents of which are incorporated herein by reference, which application claims the benefit of earlier filed and copending provisional application Ser. No. 60/000,143, filed on Jun. 12, 1995.

BACKGROUND OF THE INVENTION

1. Field of the Invention

This invention relates to an improved pulping process which utilizes non-ionic and anionic surfactants as solubilizing agents to enhance white liquor penetration into wood chips and the like during chemical pulping.

2. Description of the Related Art

Chemical pulping is a process whereby wood chips, wood shavings, and/or sawdust are heated at elevated temperatures in an aqueous acid or alkaline solution, also known as white liquor or cooking liquor, in order to remove enough lignin so that the cellulose fibers can be readily separated from one another. Typically, the process is carried out by heating a mixture of wood chips and cooking liquor in a large pressure vessel called a digester. The cooking temperature is usually in the 170°–175° C. range with a corresponding cooking time of 90 minutes. The cooked chips are discharged or blown from the digester under pressure, the mechanical force of which breaks up the wood chips into individual fibers, producing the pulp. The pulp from the digester contains fiber and exhausted liquor which is black in color. The black liquor is washed from the pulp which is then screened to remove uncooked chips and other large fragments and sent on for further processing.

The efficiency of the pulping process is reflected in the degree of delignification which depends upon the extent of the penetration of the cooking liquor and the uniformity of the distribution of the liquor within the chips. Inadequate impregnation usually results in a high level of screen rejects and low pulp yield. The current trends in research and development of the pulping industry are leading towards the use of digester aids. Digester aids are materials that are added to the white liquor to increase the yield and rate. To be most efficient, these digester aids must be soluble and stable under the pulping conditions.

Anthraquinone is an example of a compound that is widely employed as a digester aid because of its relatively low cost and lack of interference with downstream paper making operations.

Unfortunately, the known digester aids are not completely satisfactory, for example, for environmental considerations in certain cases or for lack of adequate penetration and extraction of undesirable organic components in other cases. Despite numerous prior attempts, there exists no known system which enhances the efficiency of the pulp digestion to desired levels while meeting other important criteria. It is therefore a principal object of the present invention to substantially enhance the rate of digestion of wood chips and thereby reduce the pulping cycle times in the production of pulp for the paper making process.

SUMMARY OF THE INVENTION

The present invention is an improvement in the conventional chemical pulping processes by improving the efficiency by which pulp cooking liquor components penetrate the wood and enable lignin and resins to be removed from the cellulosic materials. The surprising discovery has been made that the addition of certain surfactants or combinations of certain surfactants to the white liquor in a conventional pulping process improves both the rate of penetration of white liquor into cellulose pulp and reduces the pulping cycle times. The process according to the invention comprises contacting wood chips and the like with a digester aid which is a liquid mixture comprised of white liquor containing at least one surfactant as disclosed herein below. The surfactant concentration in the liquid mixture and the contact time with the pulp chips are each adjusted so that resinous components are extracted from the pulp without substantial degradation of cellulose. After contacting at least a portion of the resulting liquid mixture-pulp combination is heated to a digestion temperature typically above about 150° C. The heating is also referred to as cooking.

The process according to the invention results in (1) acceleration of the cooking liquor penetration by reducing its surface tension, (2) the dissolution and emulsification of the resinous components that inhibit liquor penetration and diffusion, thereby significantly enhancing the penetration of the liquor into the wood chips, and (3) enhanced delignification. When the pulping solution is alkaline, the affected alkali uptake by the chips increases by several percentage points compared to the uptake obtained in the absence of a surfactants employed in the process according to the invention.

DETAILED DESCRIPTION OF THE INVENTION

Other than in the claims and in the operating examples, or where otherwise indicated, all numbers expressing quantities of ingredients or reaction conditions used herein are to be understood as modified in all instances by the term "about".

As employed herein, the term "white liquor" means an aqueous mixture of alkali metal hydroxide and a sulfide with or without further additives and in concentrations well known in the art. The Kappa number, which is directly proportional to the amount of lignin remaining in the pulp, is the volume (in millimeters) of 0.1N potassium permanganate solution consumed by one gram of moisture-free pulp under the conditions specified in TAPPI method T 236 cm-85, the method used to determine the Kappa number.

The term pulping cycle time as used herein refers to the time required to cook a sample of wood chips and the like to a given residual effective alkali.

In the process according to the invention, wood chips, wood shavings, sawdust and the like are contacted with a liquid mixture comprised of white liquor and one or more surfactants which are soluble in white liquor and which are selected from the group consisting of polymethylalkylsiloxanes of the formula II; alkoxylated silicones; co- or terpolymers of silicones and alkoxylated polyhydric alcohols; alkoxylated aryl phosphates; alkoxylated branched alkyl phosphates; alkoxylated branched and unbranched alcohols; alkyl polyglycosides and alkoxylated alkyl polyglycosides; alkali metal salts of alkyl aromatic sulfates, sulfosuccinates and a silicone; and mixtures thereof.

Nonionic surfactants which are useful in the practice of this invention are those having an HLB value of from 9 to 16 and are selected from the group consisting of polymethylalkylsiloxanes; alkoxylated silicones; co- or terpolymers of alkoxylated silicones alkoxylated branched and unbranched aliphatic alcohols; and alkyl polyglycosides. Anionic surfactants which are useful in the practice of this invention are those selected from the group consisting of a mixture of alkali metal salts of alkyl aromatic sulfates, sulfosuccinates and a silicone; alkoxylated aryl phosphates; alkoxylated branched alkyl phosphates and mixtures thereof.

Polymethylalkylsiloxanes are compounds of the formula II

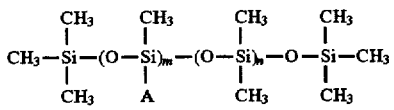

(II)

wherein $A=(CH_2)_x—O—(C_2H_4O)_y—(C_3H_6O)_z—R$; R is an organic moiety having from 1 to 8 carbon atoms such as an alkyl and/or alkenyl group, a substituted alkyl and/or alkenyl group, an acyloxy group; m is a number from 1 to 100, n is a number from 0 to 100, x is an integer from 1 to 3, y is a number from 1 to 100 and, z is a number from 0 to 100. Preferred polymethylalkylsiloxanes are those wherein n=0, m=1, x=3, y=8, z=0 and, R is methyl; n=35, m=11, x=3, y=18, z=0 and, R is methyl; n=0, m=1, x=3, y=8, z=0 and, R is acetoxy.

In the case of silicones and copolymers of silicones and ethoxylated polyhydric alcohols, relatively high degrees of ethoxylation, e.g., about 12 to 44, preferably about 22 to 44, have been found to be preferable for the purposes of this invention. These findings are applicable to a wide range of branched alkyl and aryl phosphates, branched alcohols, alkyl polyglycosides, and like compositions and mixtures.

Alkoxylated silicones, co- and terpolymers of alkoxylated silicones are described in WO 92/05854, the entire contents of which are incorporated herein by reference.

An alkoxylated polyol is any compound having at least 2 alcohol groups wherein all or substantially all of the alcohol functionalities are etherified with a polyoxyalkylene having a degree of polymerization of at least 2 examples of which include but are not limited to ethoxylated polyols, propoxylated polyols, butoxylated polyols, and random and block ethoxylated-propoxylated polyols. Preferably, the alkoxylated polyols are ethoxylated polyols.

An ethoxylated polyol is any compound having at least 2 alcohol groups wherein all or substantially all of the alcohol functionalities are etherified with polyoxyethylene having a degree of polymerization of at least 2. Such ethoxylated polyols include, but are not limited to, ethoxylated diols such as ethylene glycol, 1,2-propylene glycol, diethylene glycol, triethylene glycol, and polyethylene glycols of various degrees of polymerization; triols such as glycerine, trimethylolethane [2-methyl-2-(hydroxymethyl)-1,3-propanediol], trimethylolpropane [2-ethyl-2-(hydroxymethyl)-1,3-propanediol]. Polyols also include pentaerythritol (2,2-dimethylol-1,3-propanediol), diglycerol (glycerol dimer), dipentaerythritol, triglycerine, and the like.

Alkoxylated aryl phosphates are phosphate esters which are a mixture of mono-, di-, and tri-esters of phosphoric acid esterified with alkoxylated phenols or alkyl-substituted phenols. Alkoxylated branched alkyl phosphates are phosphate esters which are a mixture of mono-, di-, and tri-esters of phosphoric acid esterified with alkoxylated branched aliphatic alcohols. Preferably, the alkoxylated aryl phosphates am ethoxylated aryl phosphates. Preferably, the alkoxylated alkyl phosphates are ethoxylated alkyl phosphates.

The alkyl polyglycosides which can be used in the invention have the formula I $$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa., 19002. Examples of such surfactants include but are not limited to:

1. APG®225 Surfactant—an alkyl polyglycoside in which the alkyl group contains 8 to 10 carbon atoms and having an average degree of polymerization of 1.7.
2. APG®425 Surfactant—an alkyl polyglycoside in which the alkyl group contains 8 to 16 carbon atoms and having an average degree of polymerization of 1.6.
3. APG®625 Surfactant—an alkyl polyglycoside in which the alkyl groups contains 12 to 16 carbon atoms and having an average degree of polymerization of 1.6.
4. APG®325 Surfactant—an alkyl polyglycoside in which the alkyl groups contains 9 to 11 carbon atoms and having an average degree of polymerization of 1.6.
5. GLUCOPON®600 Surfactant—an alkyl polyglycoside in which the alkyl groups contains 12 to 16 carbon atoms and having an average degree of polymerization of 1.4.
6. PLANTAREN®2000 Surfactant—a $C_{8-16}$ alkyl polyglycoside in which the alkyl group contains 8 to 16 carbon atoms and having an average degree of polymerization of 1.4.
7. PLANTAREN®1300 Surfactant—a $C_{12-16}$ alkyl polyglycoside in which the alkyl groups contains 12 to 16 carbon atoms and having an average degree of polymerization of 1.6.
8. GLUCOPON®220 Surfactant an alkyl polyglycoside in which the alkyl group contains 8 to 10 carbon atoms and having an average degree of polymerization of 1.5.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkyl polyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The alkoxylated branched and unbranched aliphatic alcohols which can be used in the process according to the invention are those branched and unbranched alcohols having from 3 to 22 carbon atoms, preferably 8 to 18 carbon atoms. Preferred compounds are ethoxylated branched and unbranched aliphatic alcohols having from 8 to 18 carbon atoms such as ethoxylated tridecyl alcohol. Preferred surfactants include anionic and nonionic surfactants selected from the group consisting of the following: (1) a polymethylalkylsiloxane of the formula II wherein n=0, m=1, x=3, y=8, z=0 and, R is acetoxy; (2) a polymethylalkylsiloxane of the formula II wherein n=35, m=11, x=3, y=18, z=0 and, R is methyl; (3) a polymethylalkylsiloxane of the formula II wherein n=0, m=1, x=3, y=8, z=0 and, R is methyl; (4) a phosphated aryl ethoxylate which is commercially available as AQUAQUEST®601P and TRYFAC® from Henkel Corporation; (5) an ethoxylated tridecyl alcohol which is commercially available as TRYCOL®5941 from Henkel Corporation; (6) a blend of sodium alkyl aromatic sulfonate, sodium sulfosuccinate and silicone which is commercially available as STANTEX®40 DF from Henkel Corporation.

Under certain conditions, aqueous solutions of non-ionic surfactants such as silicones or ethoxylated surfactants exhibit limited solubility as the temperatures rise. Furthermore, under caustic conditions, these surfactants may phase separate and degrade into a dark gel phase. This lessens their desirability for specific applications as digester additives, despite their very good wetting ability under normal pH and temperatures. Alkyl polyglycosides have been found to enhance the solubility of non-ionic and anionic surfactants in alkaline media. The blends exhibit good thermal stability and remain stable over a wide range of temperatures. Alkyl polyglycosides have been found to enhance the solubility of ethoxylated surfactants. The performance of selected non-ionic and anionic surfactants as wetting agents, penetrants and deresinators improves significantly when used with alkyl polyglycosides. The alkyl polyglycosides which may be used in combination with the surfactants of this invention have the formula I and are set forth above. Combinations of alkyl polyglycosides of the formula I and polymethylalkylsiloxane of the formula II are preferred. Mixture containing from about 90/10 to about 10/90 (wt/wt) and preferably from about 75/25 to about 10/75 of a polymethylalkylsiloxane of the formula II wherein n=0, m=1, x=3, y=8, z=0 and, R is methyl and an alkyl polyglycoside of the formula I wherein $R_1$ is an alkyl group having from 8 to 10 carbon atoms b is zero and a is 1.5 are preferred. The most preferred surfactant system is a 10/75 (wt:wt) mixture of a polymethylalkylsiloxane of the formula II wherein n=0, m=1, x=3, y=8, z=0 and, R is methyl and an alkyl polyglycoside of the formula I wherein $R_1$ is an alkyl group having from 8 to 10 carbon atoms b is zero and a is 1.5.

The contacting or residence time may vary with the type of pulp and will be easily determinable by those skilled in the art. The residence time for contacting is preferably between about 45 minutes and about 180 minutes. The contacting temperature may vary with the type of pulp and will be easily determinable by those skilled in the art. The contacting temperature is preferably maintained at or below about 80° C. The digestion temperature can vary but will typically be above about 150° C. and is preferably between 160°–175° C.

The concentration of surfactant in the white liquor which together form the liquid mixture for contacting the pulp can be any amount that is effective to extract the resinous components from the pulp without substantially degrading the cellulose. Typically, the amount of surfactant will range from 0.05% (w/w) to 1.0% and preferably between about 0.05% (w/w) and about 0.5% (w/w) and most preferably from 0.125% to 0.25% based on the weight of oven dry wood. Typically, the specific components extracted from the wood chips include resins, fatty acids, and lignins.

The liquid mixture which contains one or more surfactants according to the invention and the white liquor is prepared by mixing the surfactants and the white liquor using standard mixing equipment. The amount of liquid mixture that can be used to treat the pulp can vary from 70% to 85% and preferably from 75% to 80% based on the weight of oven dry wood.

The present invention is applicable to any chemical pulping process including the pulping of wood chips from oak, gum, birch, poplar and maple trees. The pulping process may be the well-known Kraft process in which wood chips are cooked in an aqueous solution containing NaOH and $Na_2S$, or an acid sulfite system.

The invention is further illustrated by the following examples.

EXAMPLE 1

LIQUOR PENETRATION DETERMINATION PROCEDURE

The extent of liquor penetration into hardwood or soft wood chips is determined by means of a gravimetric test. The cooking liquor comprises 0.25% of a surfactant in white liquor on a weight basis. The liquor may be sodium hydroxide for soda pulping, or a mixture comprising sodium hydroxide and sodium sulfide for Kraft pulping. The liquor is pre-heated at 70° C. The chips are immersed in the liquor (Kraft or soda) for a period of 30 minutes. The temperature is maintained constant over the impregnation time. The chips are then filtered from the liquor and weighed. The liquor uptake is calculated as a ratio of the weight of penetrated chips over the weight of the initial chips. The black liquors generated are submitted to tests described below. The composition of a typical cooking liquor is as follows:

NaOH Concentration: 25.6g/l as $Na_2O$
Na2S Concentration: 9.75g/l as $Na_2O$
Sulfidity: 27.6%
Liquor/Wood Ratio: 4/1

EXAMPLE 2

ANALYSIS OF BLACK LIQUOR

The residual alkali and the amount of organic material extracted from the wood chips are determined according to standard methods. Active alkali, total alkali and effective alkali (EA) are defined in TAPPI Standard T1203 os-61 and are determined using TAPPI methods T624 cm-85 and T625 cm-85. The effective alkali of black liquors is defined as the residual effective alkali. The alkali content is determined by means of a standard titration method as set forth in the TAPPI method. Effective alkali uptake (EAU) is calculated and used as a measure of the hydroxyl uptake at the initial phase of delignification. Effective Alkali Uptake (EAU)is given by the following equation:

$$EAU=((EA_{white\ liquor}-\text{Residual } EA_{black\ liquor})/EA_{white\ liquor})\times 100$$

The residual sodium sulfide and percent sulfidity are also determined.

EXAMPLE 3

STANDARD KRAFT PULPING PROCEDURE

A 4-liter pressure reactor is charged with white liquor and heated to 80° C. The digester aid, one or more of the surfactants disclosed herein, is added slowly. Wood chips are then added so that the liquor to wood ratio is from 4:1 to 3:1 based on weight of oven dry wood. The reactor is purged with nitrogen and then sealed. The temperature is increased at such a rate that it reaches a maximum of 170° C. in one hour. The temperature and reaction rate are recorded every 10 minutes and used to calculate the total H-factor for a particular pulping study. For example, a pulping reaction is studied so that an H-factor is identified for a given temperature reading at a given time. The reaction rates are found in table 13 on page 50 of Pulp and Paper Manufacture, Volume 5, third edition, 1989, the entire contents of which are incorporated herein by reference, which lists the H-factors for temperatures from 100° C. to 199° C. (see also Pulp Paper Mag. Can., Volume 58, pages 228–231 (1957)). The H-factor for each temperature up to 170° C. is recorded and added together. The sum of the H-factors will lie in the range of 800–1150. Pulping runs are cooked to the same H-factors and the data for the same H-factor runs are compared. The shorter the time period required to arrive at a given H-factor the more efficient the pulping reaction and the shorter the cycle time. Black liquor samples are taken from the reactor at the same time intervals that the temperatures are recorded. Lignin and total organic content of black liquors are determined by means of ultraviolet spectroscopy as set forth in Example 6. The Kappa number for each run is determined according to TAPPI method T 236 cm-85. Since the Kappa number measures the amount of lignin remaining in the pulp, the lower the Kappa number for a given cook, the more efficient the lignin removal.

EXAMPLE 4

SOLUBILITY AND CLOUD POINT MEASUREMENTS

Solubility and stability of the surfactants which were used to make up the digester aids according to the invention were assessed through determination of cloud point and phase separation. Solutions comprising a surfactant or a mixed surfactant system were heated up to 100° C., or to the point where the solutions turned turbid or phase separated. The temperature at which turbidity or phase separation is observed is the cloud point of the solution, which is the lowest temperature at which a stable and homogeneous solution can be found, at this concentration.

EXAMPLE 5

WETTING ABILITY OF THE DIGESTER AIDS

The change in enthalpy per surface area is related to the surface free energy associated with the wetting of wood chips. An exothermic heat is observed when wetting takes place. The magnitude of the change in enthalpy is an indication of the wettability of the chips, and the ability of the digester aids to enhance wetting. Surface tension measurement and critical micelle concentration for specific surfactants provide critical information on wetting and solubilizing ability of the digester aids.

EXAMPLE 6

LIGNIN AND TOTAL ORGANIC ANALYSIS

Black or white liquor is filtered using a 0.2 μm pore size filter. About 20 ml of the filtrate is diluted with distilled water to a volume of 10 ml. UV absorption spectrum is taken with respect to the initial white liquor in the region of 190 nm to 450 nm, using a Perkin-Elmer UV/visible spectrophotometer and 1 -cm quartz cuvette. For quantitative determination, the areas under the peaks are integrated using a FTIR-UV software. The UV spectrum shows three specific maxima between 250 nm and 360 nm, at 268, 290, 360 respectively. A standard is made by dissolving alkali lignin in white liquor in a wide range of concentrations. Absorption of the lignin samples is measured as described above. Two maxima are observed in the region between 250 nm–300 nm. Consequently, for the black liquors, the peaks in the 250–300 nm regions are considered specifically caused by lignin structural groups. The total organic extraction is calculated from the maxima obtained in the entire 250–450 region.

Tables 1–5 illustrate the efficacy of the digester aids according to the invention. Table 1 illustrates the effect of surfactant composition on the ability of a digester aid to remove lignin from pulp. The combination of TEGOPREN®5878 and GLUCOPON®220 (1:7.2) is most efficient in removing lignin. TEGOPREN®5878 is a polymethylalkylsiloxane. The amounts of the various extracts is proportional to the absorbency at the indicated wavelengths.

Table 2 shows the effect of the preferred digester aid, TEGOPREN®5878-GLUCOPON®220 (75:25) as a digester aid in various pulping runs using Scandinavian softwood at a dosage of digester aid equal to 0.125% based on dry wood weight and 28.5% sulfidity. All runs in Table 2 were cooked to an H-factor of 1150. Table 3 shows the Kappa number for various digester aids at two different additive dose rates. Table 4 shows the Kappa number and number of rejects for various digester aids at different active alkali amounts as percentages of dry wood weight. The following surfactant compositions pertain to each of the tables below where indicated. The control is white liquor having no digester additives. Additive A is TRYCOL®5941-GLUCOPON®220 (1:1 ). Additive B is DC®25212, trademark product of Dow Chemical. Additive C is S911, a trademark product of Wacker Silicones. Additive D is AQUAQUEST®610-GLUCOPON®220 (1:1), both trademark products of Henkel Corporation. Additive E is STANTEX®40DF a trademark product of Henkel Corporation. Additive F is TEGOPREN®5878-GLUCOPON®220 (75:25). TEGOPREN®5878 is a trademark product of Goldschmidt Chemical. Table 5 shows the efficiency of the TEGOPREN®5878-GLUCOPON®220 combination at various blend ratios. The data in Tables 1, 2 and 5 was obtained using Scandinavian softwood while the data in Tables 3 and 4 was obtained using U.S. hardwood.

TABLE 1

| Pulping of Scandinavian Softwood Lignin Removal Efficiency | | | |
|---|---|---|---|
| Surfactant | 268 nm[1] | 290 nm[2] | 336 nm[3] |
| Control | 0.872 | 0.795 | 0.398 |
| A | 1.036 | 0.916 | 0.512 |
| B | 1.055 | 0.929 | 0.552 |
| C | 0.994 | 0.934 | 0.521 |
| D | 0.990 | 0.885 | 0.495 |
| E | 0.985 | 0.887 | 0.484 |
| F | 1.134 | 0.986 | 0.556 |

[1]absorption at 268 nm
[2]absorption at 290 nm
[3]absorption at 338 nm

TABLE 2

| Efficiency of TEGOPREN ® 5878 - GLUCOPON ® 220 (75:25) | | | | |
|---|---|---|---|---|
| | Kappa Number | | Number of Rejects | |
| Active Alkali | Additive | Control | Additive | Control |
| 18 | 27 | 30 | 0.7 | 2.8 |
| 20 | 25.8 | 25.6 | 0.7 | 0.53 |
| 22 | — | 22.27 | — | 0.53 |

TABLE 3

| Kappa Number for Various Digester Aids at Two Different Additive Dose Rates | | |
|---|---|---|
| Surfactant[1] | At 0.125% | At 0.25% |
| A | 17.9 | 17.2 |
| B | 17.4 | 18.6 |
| C | 18.1 | 17 |
| D | 17.7 | 17.8 |
| E | 17.8 | 17.2 |
| F | 17.2 | 16.9 |

TABLE 4

| Kappa Number and Rejects for Various Digester Aids at Different Active Alkali | | | | | | | | |
|---|---|---|---|---|---|---|---|---|
| | Kappa Number | | | | Number of Rejects | | | |
| Surfactant | 15.5% | 16.5% | 17.5% | 18.5% | 15.5% | 16.5% | 17.5% | 18.5% |
| Control | 20.1 | 19.2 | 17.8 | 16 | 2.43 | 2 | 1.9 | 1.7 |
| E | 19 | 17.5 | 17.9 | 16.7 | 3 | 1.8 | 0.9 | 1.8 |
| F | 18.5 | 17.6 | 17.2 | 15.8 | 1.4 | 2.6 | 0.8 | 1.3 |

TABLE 5

Efficiency of TEGOPREN ® 5878-GLUCOPON ® 220 at Various Blend Ratios Pulping of Scandinavian Softwood

| Surfactant | Surfactant Blend Weight Ratio | Additive Dose* (w/w %) | Active Alkali % | Kappa Number | Rejects Level (%) | Screen Yield (%) |
|---|---|---|---|---|---|---|
| Control | 0 | 0 | 18 | 30 | 2.8 | 43.1 |
| TEGOPREN/ GLUCOPON 220 | 75:25 | 0.125 | 18 | 27 | 0.7 | 45.8 |
| TEGOPREN/ GLUCOPON 220 | 1:7.5 | 0.063 | 18 | 28.2 | 0.8 | 45.3 |
| TEGOPREN/ GLUCOPON 220 | 1:7.2 | 0.063 | 18 | 25.75 | 0.85 | 46.1 |

*% based on the weight of dry wood

What is claimed is:

1. A pulping process which comprises contacting wood chips and the like with a liquid mixture comprised of white liquor and a polymethylalkylsiloxane of the formula II

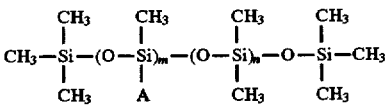

(II)

wherein $A=(CH_2)_x—O—(C_2H_4O)_y—(C_3H_6O)_z—R$; R is an organic moiety having from 1 to 8 carbon atoms, m is a number from 1 to 100, n is a number from 0 to 100, x is an integer from 1 to 3, y is a number from 1 to 100 and, z is a number from 0 to 100.

2. The process of claim 1 wherein the process is carried out a temperature of at least 150° C.

3. The process of claim 1 wherein the amount of said surfactant in said liquid mixture is from about 0.125 to about 0.5 weight %.

4. The process of claim 1 wherein the amount of said surfactant in said liquid mixture is from about 0.05 to about 0.25 weight %.

5. The process of claim 1 wherein the amount of said liquid mixture is from about 70% to about 85% based on the weight of oven dry wood.

6. The process of claim 1 wherein the amount of said liquid mixture is from about 75% to about 80% based on the weight of oven dry wood.

7. The process of claim 1 wherein said liquid mixture further comprises an alkyl polyglycoside of the formula I $R_1O(R_2O)_b(Z)_a$ I wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6.

8. The process of claim 7 wherein the weight ratio of said polymethylalkylsiloxane to said alkyl polyglycoside is from about 90/10 to about 10/90.

9. The process of claim 8 wherein the weight ratio of said polymethylalkylsiloxane to said alkyl polyglycoside is from about 75/25 to about 25/75.

10. The process of claim 7 wherein in said polymethylalkylsiloxane of the formula II n=0, m=1, x=3, y=8, z=0 and, R is methyl and in said alkyl polyglycoside of the formula I $R_1$ is an alkyl group having from 8 to 10 carbon atoms b is zero and a is 1.5.

11. The process of claim 10 wherein the weight ratio of said polymethylalkylsiloxane to said alkyl polyglycoside is from about 90/10 to about 10/90.

12. The process of claim 11 wherein said ratio is from about 75/25 to about 25/75.

13. A process which comprises contacting wood chips and the like with a liquid mixture comprising white liquor comprising a surfactant mixture comprising a polymethylalkylsiloxane of the formula II

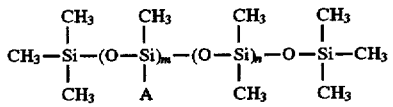

(II)

wherein $A=(CH_2)_x—O—(C_2H_4O)_y—(C_3H_6O)_z—R$; R is an organic moiety having from 1 to 8 carbon atoms, m is a number from 1 to 100, n is a number from 0 to 100, x is an integer from 1 to 3, y is a number from 1 to 100 and, z is a number from 0 to 100 and an alkyl polyglycoside of the formula I $R_1O(R_2O)_b(Z)_a$ I wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6 for a residence time effective to extract resinous components without substantial degradation of cellulose and thereafter heating at least a portion of the resulting mixture and wood chips.

14. The process of claim 13 wherein the weight ratio of said polymethylalkylsiloxane and said alkyl polyglycoside is from about 90/10 to about 50/50.

15. The process of claim 14 wherein the weight ratio of said polymethylalkylsiloxane to said alkyl polyglycoside is from about 90/10 to about 75/25.

* * * * *